US011408687B2

(12) United States Patent
Sus et al.

(10) Patent No.: US 11,408,687 B2
(45) Date of Patent: Aug. 9, 2022

(54) HEAT EXCHANGER ASSEMBLY

(71) Applicant: Valeo Autosystemy Sp. z o.o., Skawina (PL)

(72) Inventors: Pawel Sus, Bietigheim-Bissingen (DE); Mateusz Kaczmarczyk, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 65 days.

(21) Appl. No.: 16/638,276

(22) PCT Filed: Aug. 14, 2018

(86) PCT No.: PCT/EP2018/071999
§ 371 (c)(1),
(2) Date: Feb. 11, 2020

(87) PCT Pub. No.: WO2019/034642
PCT Pub. Date: Feb. 21, 2019

(65) Prior Publication Data

US 2020/0173737 A1 Jun. 4, 2020

(30) Foreign Application Priority Data

Aug. 17, 2017 (EP) ..... 17461592

(51) Int. Cl.
*F28F 9/007* (2006.01)

(52) U.S. Cl.
CPC ..... *F28F 9/0075* (2013.01)

(58) Field of Classification Search
CPC ..... F28F 9/0075; F28F 9/001; F28F 9/002; F28F 2235/00; F28F 2240/00;
(Continued)

(56) References Cited

U.S. PATENT DOCUMENTS 3,995,688 A * 12/1976 Darm ..... B23P 15/26 165/165
4,120,283 A * 10/1978 Eder ..... F24S 10/30 126/665

(Continued)

FOREIGN PATENT DOCUMENTS

CN 103582796 A 2/2014
CN 104303002 A 1/2015

(Continued)

OTHER PUBLICATIONS

FR-3008174-A1—English machine translation.pdf (Year: 2015).*

(Continued)

*Primary Examiner* — Jianying C Atkisson
*Assistant Examiner* — Jose O Class-Quinones
(74) *Attorney, Agent, or Firm* — Osha Bergman Watanabe & Burton LLP

(57) ABSTRACT

A heat exchanger assembly comprising a frame (10) and a heat exchanger (20), wherein the heat exchanger (20) comprises a core of plates (21) stacked in a first direction, with edges (22) protruding along their outline, characterized in that the frame (10) comprises a retaining element (30) configured to engage plate edges (22) so that the retaining element (30) restricts movement of the heat exchanger (20) with respect to the frame (10) in the first direction, wherein the retaining element (30) comprises an elongated core (31) attached to the frame (10) and plurality of protrusions (32) protruding from this core (31), said protrusions (32) configured to protrude between plate edges (22).

10 Claims, 3 Drawing Sheets

(58) Field of Classification Search
CPC .... F28F 2225/00; F28F 2225/04; F28F 9/262; F28F 2280/06; F28F 2265/30; F28F 2265/32; B60K 11/04; F01P 3/18; B62D 25/084
See application file for complete search history.

(56) References Cited

U.S. PATENT DOCUMENTS 4,183,402 A * 1/1980 Cotter ..... F28D 1/0316 165/175
5,167,274 A * 12/1992 Mueller ..... C05G 5/12 165/301
5,228,515 A * 7/1993 Tran ..... F28D 9/0037 165/166
5,465,785 A * 11/1995 Adderley ..... F28D 9/0006 165/166
5,661,906 A * 9/1997 Beier ..... B23K 31/02 29/890.039
5,791,402 A * 8/1998 Dumetz ..... F28F 9/002 165/67
6,382,312 B2 * 5/2002 Avequin ..... F28D 1/0435 165/140
7,004,237 B2 * 2/2006 Mathur ..... F28D 9/0006 165/167
8,016,025 B2 * 9/2011 Brost ..... F28F 9/0229 165/149
8,453,721 B2 * 6/2013 Mathur ..... F28F 9/005 165/157
8,978,740 B2 * 3/2015 Schatz ..... F28F 9/0137 165/69
2006/0054306 A1 * 3/2006 Kent ..... F28F 9/002 165/67
2006/0086875 A1 * 4/2006 Brown ..... F28F 9/007 248/300
2007/0023174 A1 * 2/2007 Brost ..... F28D 9/0037 165/166
2010/0276131 A1 * 11/2010 Barwig ..... F02M 26/32 165/162
2011/0024082 A1 * 2/2011 Bharne ..... F28F 3/083 165/95
2012/0118542 A1 * 5/2012 Kanzaka ..... F28D 9/005 165/148
2012/0255709 A1 * 10/2012 Kinder ..... F28F 9/0075 165/67
2013/0087317 A1 * 4/2013 Papoulis ..... F28F 3/044 165/177
2014/0246184 A1 * 9/2014 Byman ..... F28F 9/26 165/166
2015/0323266 A1 11/2015 Bardeleben et al.
2016/0097596 A1 * 4/2016 Stewart ..... F02B 29/0462 165/175
2017/0131035 A1 * 5/2017 Honnorat ..... B64D 27/10
2017/0362988 A1 * 12/2017 Matsuura ..... F28F 3/06
2017/0370651 A1 * 12/2017 Somhorst ..... F28F 9/02

FOREIGN PATENT DOCUMENTS

CN 205137843 U 4/2016
EP 1191297 A2 3/2002
EP 1635131 A1 3/2006
FR 2447529 A1 8/1980
FR 3008174 A1 * 1/2015 ..... F28F 9/002

OTHER PUBLICATIONS

First Office Action in corresponding Chinese Application No. 201880063619.3, dated Mar. 2, 2021 (11 pages).
International Search Report and Written Opinion in corresponding International Application No. PCT/EP2018/071999, dated Oct. 31, 2018 (8 pages).

* cited by examiner

HEAT EXCHANGER ASSEMBLY

FIELD OF THE INVENTION

The invention relates to a heat exchanger assembly, and more particularly to a heat exchanger assembly comprising a heat exchanger in a frame.

BACKGROUND OF THE INVENTION

Heat exchangers for vehicles, for example cars, are commonly known in the art. An example of such heat exchanger is a liquid-cooled condenser, which comprises a core consisting of stacked corrugated inner plates forming a heat transfer surfaces, which plates all have the same or similar pattern and dimensions of corrugations. The plates may be extruded to form a pattern of bulges and recesses on their surface. Combining the plates into a stack or a packet in a leak-proof manner, for example by brazing, soldering or screwing between outer end panels, forms compartments between the plates with a system of channels that provide turbulent flow of a coolant or a refrigerant, respectively. The plates are also provided with openings made in appropriate places, which, after the sealing a packet of plates, form inlet and outlet channels for heat transfer media.

A heat exchanger must be mounted in the interior of the vehicle and connected to the circuits of appropriate fluids. The size and the connection possibilities of these exchangers are especially critical for the integration of the heat exchanger into the vehicle. In addition, ready accessibility to the connection between the heat exchanger and the rest of the circuits is sought in order to facilitate assembly and subsequent maintenance operations.

Many further requirements are placed on such attachment, stemming from both cost effectiveness and specific environment. For example, the connection of the heat exchanger to the vehicle should not be affected by shocks and vibrations. Space requirements also play a role, wherein placement with respect to other elements of vehicle in very limited space available makes an effective design of the connection arrangement a complicated effort. In addition, some vehicles are equipped with ready interfaces for attaching the heat exchanger units. Consequently, a heat exchanger unit must be designed to perform its function while being compatible with specific, often very strict interface requirements.

In some designs, the heat exchanger is attached to the interface by means of a frame. Such frame holds the heat exchanger and at the same time comprises means for securing the whole assembly to the vehicle. Thus, it is crucial to provide a secure connection between the frame and the heat exchanger.

SUMMARY OF THE INVENTION

The object of the invention is, among others, a heat exchanger assembly comprising a frame and a heat exchanger, wherein the heat exchanger comprises a core of plates stacked in a first direction, with edges protruding along their outline, characterized in that the frame comprises a retaining element configured to engage plate edges so that the retaining element restricts movement of the heat exchanger with respect to the frame in the first direction, wherein the retaining element comprises an elongated core attached to the frame and plurality of protrusions protruding from this core, said protrusions configured to protrude between plate edges.

Preferably, at selected number of consecutive plates, each space between plate edges comprises a protrusion of the retaining element.

Preferably, the protrusions have a pitch equal or being a multiplication of the pitch of the stacked plates of the heat exchanger.

Preferably, the core of the retaining element has height H1 at least equal to the height H2 of the protrusions.

Preferably, the retaining element is in form of a comb-like structure with protrusions formed as teeth.

Preferably, the retaining element is configured to restrict movement in a second direction.

Preferably, the protrusions are press-fitted between plate edges.

Preferably, between at least part of protrusions and the plate edges there is provided an adhesive bonding these elements.

Preferably, the retaining element is made of an elastic material.

Preferably, the retaining element is a separate element which is attached to the frame.

Preferably, the retaining element is an integral part of the frame.

BRIEF DESCRIPTION OF DRAWINGS

Examples of the invention will be apparent from and described in detail with reference to the accompanying drawings, in which.

DETAILED DESCRIPTION OF EMBODIMENTS

Figure 1:
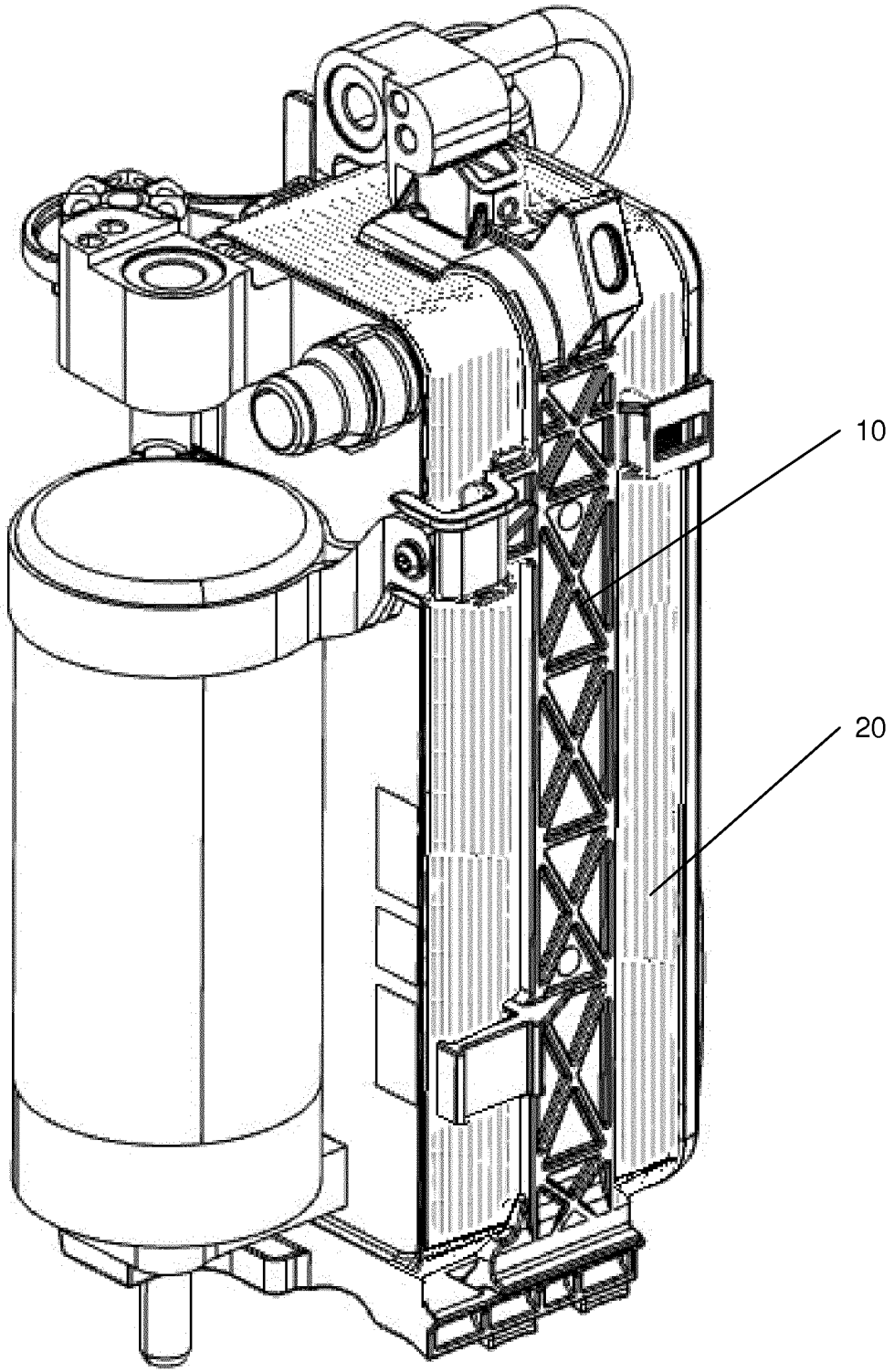
FIG. 1 shows a heat exchanger assembly.

FIG. 1 shows a heat exchanger assembly. The heat exchanger assembly comprises a heat exchanger 20 and a frame 10. Frame 10 is utilized, for example, to attach the heat exchanger to the vehicle, e.g. through a dedicated interface. It can also be utilized as an attachment base for other elements of the heat exchanger assembly, e.g. a bottle.

The heat exchanger 20 is a plate heat exchanger comprising a plurality of plates 21 stacked in a first direction, wherein between the top closure plate and the bottom closure plate there are provided stacked inner plates, arranged parallel to each other. They can be arranged alternately with respect to each other and be adapted for directing the flow of a first fluid and of a second fluid. The heat exchanger can be formed substantially in a shape of a parallelepiped, with two wider side walls and two narrower side walls, accompanied by a bottom wall and a top wall. These walls form substantially flat planes delimited by consecutive plate edges.

Plates of the heat exchanger comprise outer edges defined along their perimeter. The edges of consecutive plates are spaced with respect to each other, so that they form free spaces.

Figure 2:
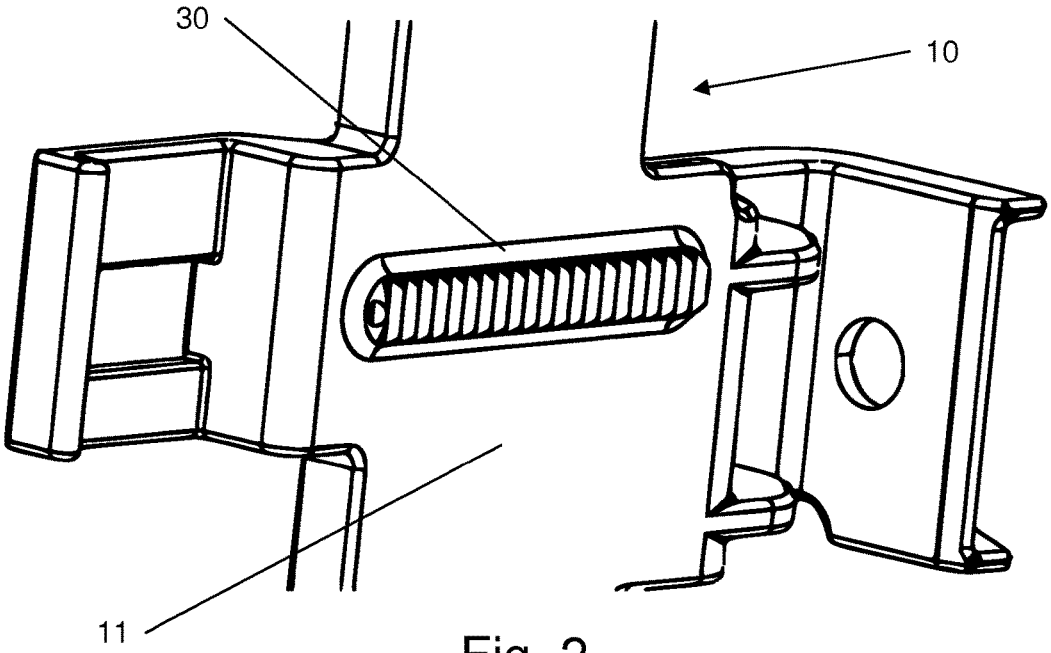
FIG. 2 shows a frame of the heat exchanger assembly in greater detail.

FIG. 2 presents a frame of the heat exchanger assembly in greater detail. The frame comprises a side wall 11, on which a retaining element 30 is located. The side wall 11 of the frame faces the side wall of the heat exchanger 20, for example a wider side wall. The retaining element 30 can be either an integral part of the frame 10, or a separate element which is attached to the frame 10. If it is an integral part of the frame 10 it can be formed at the same time as the rest of the frame 10. It is envisaged that a metal insert can be introduced into form and the rest of material can be injected subsequently. In other possible solutions, the retaining element can be a separate element connected to the frame by means of a shaped, push-in connection.

Figure 3:
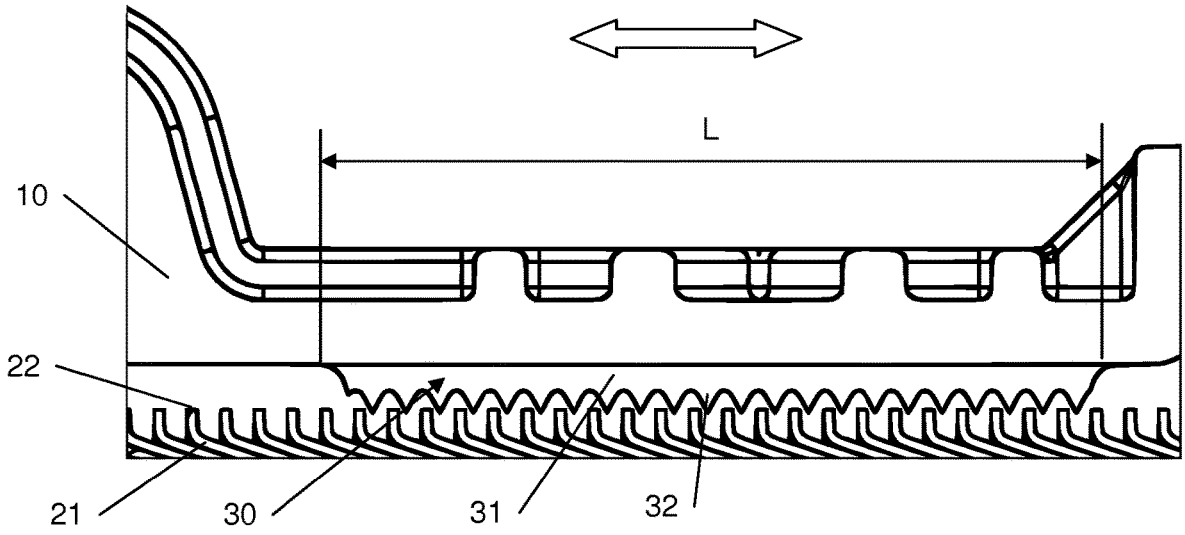
FIG. 3 shows a retaining element of the frame.

FIG. 3 shows a retaining element of the frame 10. The retaining element 30 comprises an elongated core 31 and protrusions 32, protruding from the core 31. The core 31 comprises a length L, along which consecutive protrusions 32 are formed. At a selected number of consecutive plates 21, each space between plate edges 22 comprises a protrusion 32 of the retaining element 30. The protrusions 32 are configured to protrude into spaces between plate edges 22. This can be achieved for example by shaping the protrusions 32 so that they fit into said spaces between plate edges 22. An example of such shape is a triangular tooth, as depicted in FIG. 3. Other shapes are also envisaged, such as semi-circular, rectangular, trapezoidal and the like. The shape of the protrusions 32 is selected such that they will protrude into space between the plate edges 22 and restrict movement of the heat exchanger 20 in at least one direction. This direction, as shown in an exemplary manner in FIG. 3, can be parallel to the direction in which the consecutive plates 21 are stacked, i.e. in the first direction. The protrusions 32 can have a pitch equal or being a multiplication of the pitch of the stacked plates 21 of the heat exchanger 20.

It is further envisaged that the protrusions can serve to restrict at least partially a movement of the heat exchanger with respect to the frame 10 also in further directions, for example in a second direction, for example parallel to the plate edges 22 and perpendicular to the first direction.

This can be achieved for example by selecting a shape of the protrusions 32 which will provide a pressing action onto surfaces of the free ends of plates perimeter. In other words, the protrusions 32 can be press-fitted between the edges 22.

The protrusions 32 (or the whole retaining element 30) can be made of an elastic material, which after application of pressure will enter space between edges and press onto opposing surfaces of plates 21, providing a movement restricting action also in at least a second direction.

Another means of achieving said movement restricting action is provision of an adhesive between protrusions 32 and the respective plate edges 22. The provision of protrusions 32 between consecutive plate edges 22 will allow the adhesive to produce a bond with these elements, essentially restricting movement in every direction.

The retaining element 30 can be located at those portions of the frame 10 which cannot comprise side clamps or other holding means which would have a stopping or a holding function. The positioning of the retaining element 30 is then selected in order to replace the function of these elements. For example, if a clamp was located near one of the narrower side walls of the heat exchanger, the retaining element will be located in the vicinity of this place and take over the retaining function of the clamp.

Further, because the retaining element 30 is constituted by a core 31 with protrusions 32, it can be readily adjusted according to specific needs by adjusting the length L of the core 31. As the number of protrusions 32 can be directly connected with the length L of the core 31, the longer the core 31, the more protrusions 32 for engaging the plate edges 32 will be present. Consequently, if there is a necessity for a stronger retaining action, the retaining element 30 is made appropriately longer. Such arrangement provides an easily scalable retaining function with minimum changes to the design.

Figure 4:
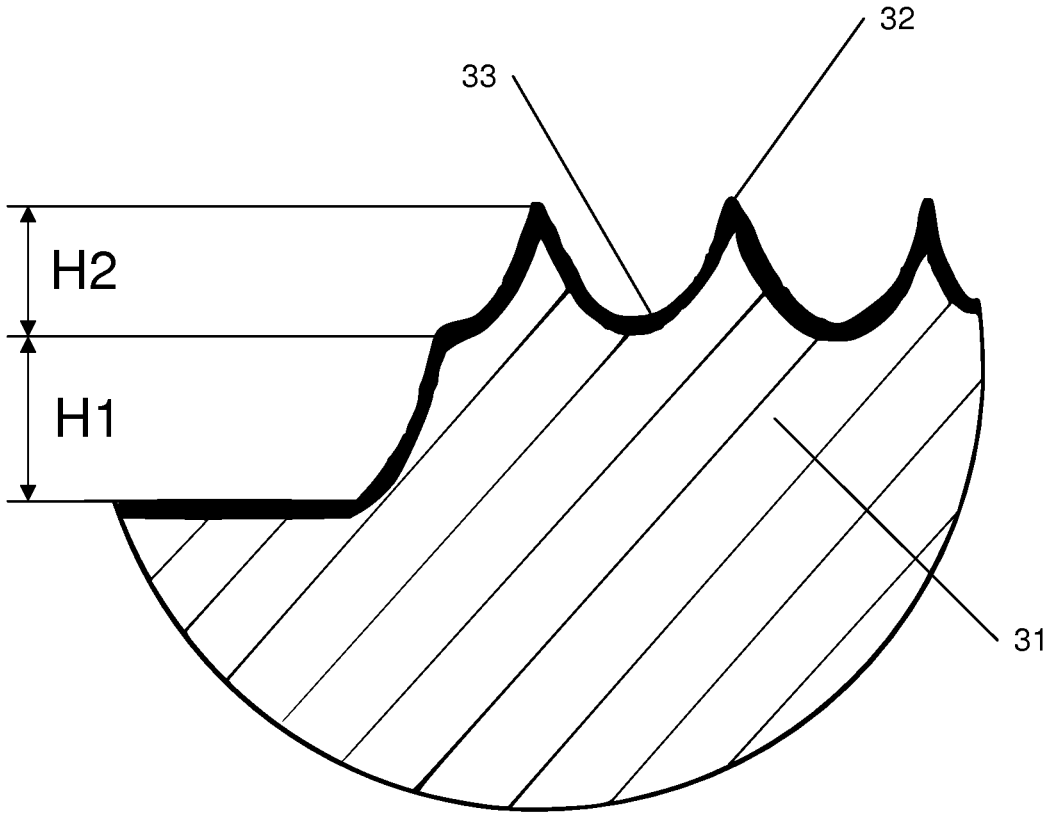
FIG. 4 shows details of the retaining element.

FIG. 4 shows a retaining element 30 in greater detail. Core 31 has a height H1, which is measured from the surface of the frame 10, which is a general surface of the frame facing the general side surface of the heat exchanger core, to a point from which protrusions 32 start to protrude from the core 31. Protrusions 32 have a height H2, which is measured from the end of the core 31 from which the protrusions 32 protrude to the opposite end of the protrusions 32 along an axis perpendicular to the general plane of the side surface of the frame 10.

Placing protrusions 32 between consecutive plate edges 22 provides an effective retaining action. It also allows to place protrusions 32 on a common core 31, which facilitates manufacturing of a single, robust element. The common core 31 also allows easier adjustment of the distance of all protrusions 32 with respect to the heat exchanger at the same time. Consequently, for frames which are further distanced from the heat exchanger, an adjustment due to the distance change can be performed by controlling solely the height H1 of the core 31. This simplifies the whole process. Preferably, the core 31 of the retaining element 30 has height H1 equal at least to height H2 of the protrusions 32. More preferably, the height H1 of the core is larger than height H2 of the protrusions. Consequently, the height H2 of the protrusions needs only to satisfy retaining action for the edges 32, and does not have to take into account any further distance between the heat exchanger 20 and the frame 10. This decreases a chance of damaging of a protrusion 32 due to stresses.

The invention claimed is:

1. A heat exchanger assembly comprising:

a frame; and a heat exchanger comprising a core of plates stacked in a first direction, with plate edges protruding along an outline of the plates, wherein the frame comprises a retaining element configured to engage with the plate edges so that the retaining element restricts movement of the heat exchanger with respect to the frame in the first direction, wherein the retaining element comprises:

an elongated core attached to the frame; and a plurality of protrusions protruding from the core of the retaining element, said protrusions configured to protrude between the plate edges, wherein the retaining element is in a form of a comb-like structure with the protrusions formed as teeth such that widths of the protrusions gradually narrow as the protrusions protrude away from the core of the retaining element, and wherein the core of the retaining element has a height H1 equal to a height H2 of the protrusions.

2. The heat exchanger assembly according to claim 1, wherein at selected number of consecutive plates, each space between the plate edges comprises a protrusion of the retaining element.

3. The heat exchanger assembly according to claim 2, wherein the protrusions have a pitch equal or being a multiplication of the pitch of the stacked plates of the heat exchanger.

4. The heat exchanger assembly according to claim 1, wherein the retaining element is configured to restrict movement in a second direction.

5. The heat exchanger assembly according to claim 1, wherein the protrusions are press-fitted between the plate edges.

6. The heat exchanger assembly according to claim 5, wherein the retaining element is made of an elastic material.

7. The heat exchanger assembly according to claim 1, wherein between at least part of the protrusions and the plate edges there is provided an adhesive bonding at least the part of the protrusions and the plate edges.

8. The heat exchanger assembly according to claim 1, wherein the retaining element is a separate element which is attached to the frame.

9. The heat exchanger assembly according to claim 1, wherein the retaining element is an integral part of the frame.

10. A heat exchanger assembly comprising:

a frame comprising a dedicated interface, wherein the dedicated interface includes a fastener, for attaching a heat exchanger to a motor vehicle; and the heat exchanger formed substantially in a parallelepiped shape with two wider side walls and two narrower side walls, a bottom wall and a top wall, the heat exchanger comprising a core of plates stacked in a first direction, with plate edges protruding along an outline of the plates, wherein the frame comprises a side wall on which a retaining element is disposed, the retaining element being configured to engage the plate edges so that the retaining element restricts movement of the heat exchanger with respect to the frame in the first direction, wherein the retaining element comprises:

an elongated core attached to the frame; and a plurality of protrusions protruding from the core of the retaining element, said protrusions configured to protrude between the plate edges, wherein the retaining element is in a form of a comb-like structure with the protrusions formed as teeth such that widths of the protrusions gradually narrow as the protrusions protrude away from the core of the retaining element, and wherein the core of the retaining element has a height H1 equal to a height H2 of the protrusions.

* * * * *